United States Patent [19]

Neu

[11] 4,080,794

[45] Mar. 28, 1978

[54] ARRANGEMENT FOR SUPPORTING ROOFS OF UNDERGROUND EXCAVATIONS

[75] Inventor: Gustav Neu, Bochum, Germany

[73] Assignee: Bochumer Eisenhutte Heintzmann GmbH & Co., Bochum, Germany

[21] Appl. No.: 783,338

[22] Filed: Mar. 31, 1977

[30] Foreign Application Priority Data

May 21, 1976 Germany ..... 2622888

[51] Int. Cl.[2] ..... E02D 15/44

[52] U.S. Cl. ..... 61/45 D

[58] Field of Search ..... 61/45 D; 299/31-33; 248/357; 91/170 MP

[56] References Cited

U.S. PATENT DOCUMENTS

| | | | |
|---|---|---|---|
| 3,885,396 | 5/1975 | Snowden et al. | 61/45 D |
| 3,921,409 | 11/1975 | Blumenthal | 61/45 D |
| 3,971,225 | 7/1976 | Wertelewski et al. | 61/45 D |
| 3,983,710 | 10/1976 | Heine | 61/45 D |

*Primary Examiner*—Dennis L. Taylor
*Attorney, Agent, or Firm*—Michael J. Striker

[57] ABSTRACT

A mine roof support for underground excavations includes a support adapted to engage the floor of the underground excavation, and a movable roof shield which engages the roof of the underground excavation. A movable rear shield is mounted on the support and is pivotally connected with the roof shield for relative movement thereto about a pivot axis. A pit prop arrangement is provided intermediate the shields and the support for moving the shields relative to each other about the pivot axis between a plurality of inclined positions in which the rear shield is inclined at different angles of inclination relative to the roof shield. A pair of abutment members are respectively provided on the shields for limiting relative movement of the latter beyond a predetermined one of the inclined positions in which the shields are inclined at a predetermined angle of inclination relative to each other.

7 Claims, 3 Drawing Figures

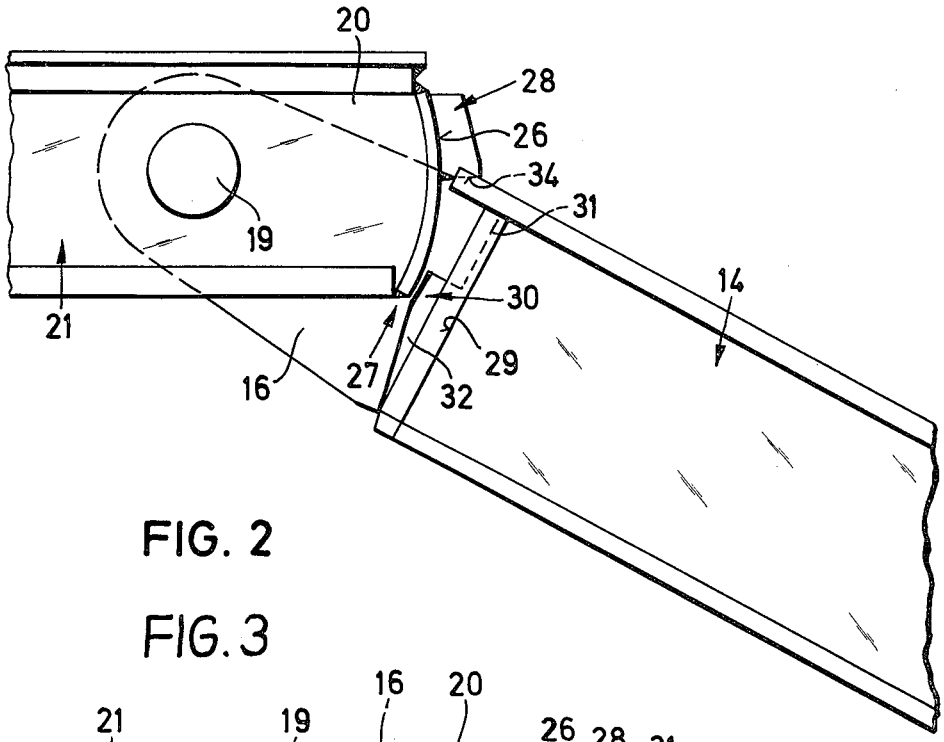
FIG. 2
FIG. 3
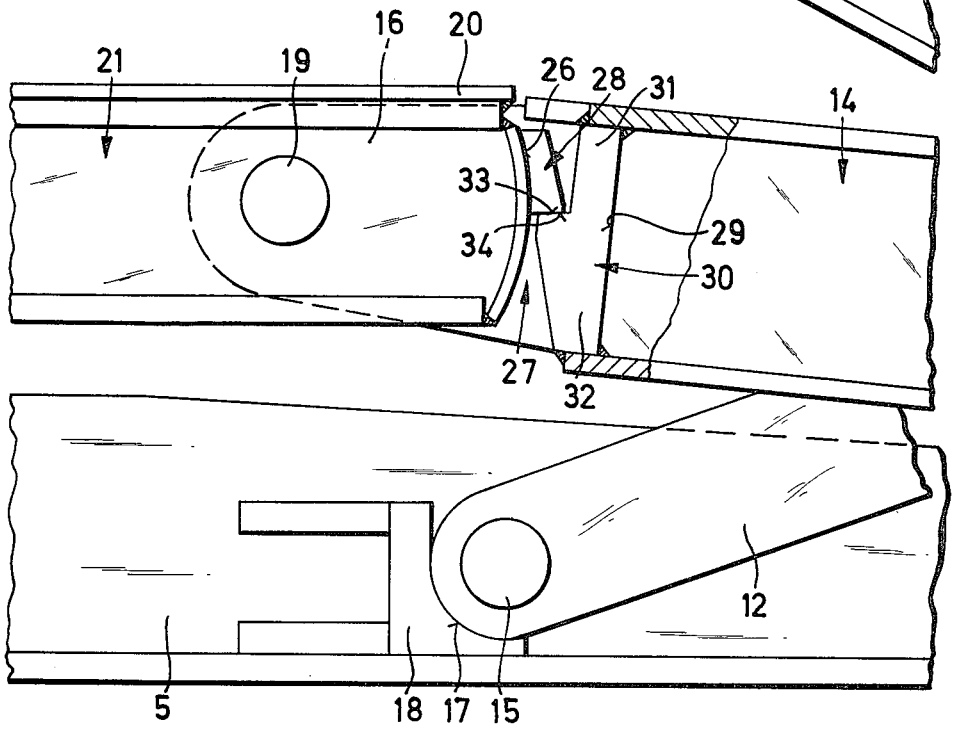

ARRANGEMENT FOR SUPPORTING ROOFS OF UNDERGROUND EXCAVATIONS

BACKGROUND OF THE INVENTION

The present invention relates generally to an arrangement for supporting roofs of underground excavations and other mining galleries. More particularly, the invention relates to improvements in so-called walking mine roof supports which are movable stepwise towards the mine face in an underground excavation.

Mine roof supporting arrangements generally comprise a mobile floor-engaging support which supports a roof shield. A rear shield is pivotally connected to the roof shield and reinforces the supporting function of the roof shield, as well as preventing any loose ore from the roof from falling into the interior of the mine roof supporting arrangement, thereby interfering with the stepwise advancement thereof. It has been proposed to use separate pit props to individually move each shield toward and away from the support.

However, the known prior-art arrangements are particularly disadvantageous in low height underground excavations because the rear shield is forced to lie along a plane which defines a very small angle relative to the plane of the floor of the excavation. Put another way: the rear shield cannot effectively reinforce the roof shield, nor divert loose ore in direction away from the mine face because of its slight slope relative to the plane of the floor.

Moreover, the possibility exists that the mine roof will generate a reaction force at the pivot connection between the rear and roof shields which will cause the rear end of the rear shield to be raised above the front end of the rear shield. The rear and roof shields thereby assume a V-shaped configuration having its open end facing the roof.

This condition is extremely dangerous. The rear end of the rear shield now engages the roof and restricts free advancement towards the mine face. The pit props cannot be further retracted to permit disengagement of the rear shield because the pit props are already in their fully retracted position in such extremely low excavations. In the event that the mine roof supporting arrangement is advanced in this relative orientation between the shields, the danger of cave-in is greatly increased. Miners are now subject to injury and death; and mine equipment are now subject to damage and destruction.

Furthermore, such low excavations cause extremely large reaction forces to be generated at all of the hinged connections between the pit props and the roof shield, the rear shield and the support. These forces tend to destroy all of these hinged connections, thereby making the entire mine roof supporting arrangement unusable.

SUMMARY OF THE INVENTION

Accordingly, it is a general object of the present invention to overcome the drawbacks to the prior art.

More particularly, it is an object of the present invention to prevent a rear shield from pivoting relative to a roof shield beyond a predetermined position relative to the latter.

Still another object of the present invention is to prevent cave-ins in underground excavations.

A further object of the present invention is to provide a mine roof supporting arrangement which can be used in low height excavations.

In keeping with these objects and others which will become apparent hereafter, one feature of the invention resides, briefly stated, in an arrangement for supporting roofs of underground excavations, which comprises a support or base adapted to engage the floor of an underground excavation, and a movable roof shield or cap for engaging the roof of the underground excavation. A movable rear shield is mounted on the support and is pivotally connected with the roof shield for relative movement thereto about a pivot axis. The arrangement further comprises means for moving the shields relative to each other about the pivot axis. The moving means or pit prop assembly is located intermediate the shields and the support and is operative for moving the shields between a plurality of inclined positions in which the rear shield is inclined at different angles of inclination relative to the roof shield. Limiting means are provided on the shields for limiting relative movement of the shields beyond a predetermined one of the inclined positions in which the shields are inclined at a predetermined angle of inclination relative to each other.

In accordance with the invention, the rear and roof shields are automatically, i.e. without manual interference on the part of mining personnel, prevented from further pivoting movement relative to each other beyond said predetermined position. The rear and roof shields are positively locked in abutment with each other and prevent the pivot connection between the shields from moving downwardly towards the support. A preferred predetermined position is obtained when the rear shield forms an obtuse angle of inclination, preferably slightly less than 180°, with the roof shield.

In a preferred embodiment, at least one projection and preferably a plurality of such projections are provided on the roof shield, and at least one and preferably a plurality of brackets are provided on the rear shield. Abutting surfaces are respectively provided on the projection and the bracket and are operative for abuttingly engaging each other only when the rear shield assumes said predetermined position. Movement of the rear shield to all other inclined positions relative to the roof shield is not effected by the cooperating projections and brackets. Of course, the projection could also be provided on the rear shield and, in that case, the bracket would be provided on the roof shield.

The projection and bracket are preferably thin-walled metal plates which are welded to respective ends of the shields. The projection preferably has a length on the order of one-half to one-third of the entire thickness of the roof shield, and the bracket has a length which extends over the major portion of the thickness of the rear shield.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 is a broken-away view of an enlarged detail of FIG. 1 in one operative condition; and FIG. 3 is a broken-away view of the enlarged detail of FIG. 2 in another operative condition.

DESCRIPTION OF THE PREFERRED EMBODIMENTS

Figure 1:
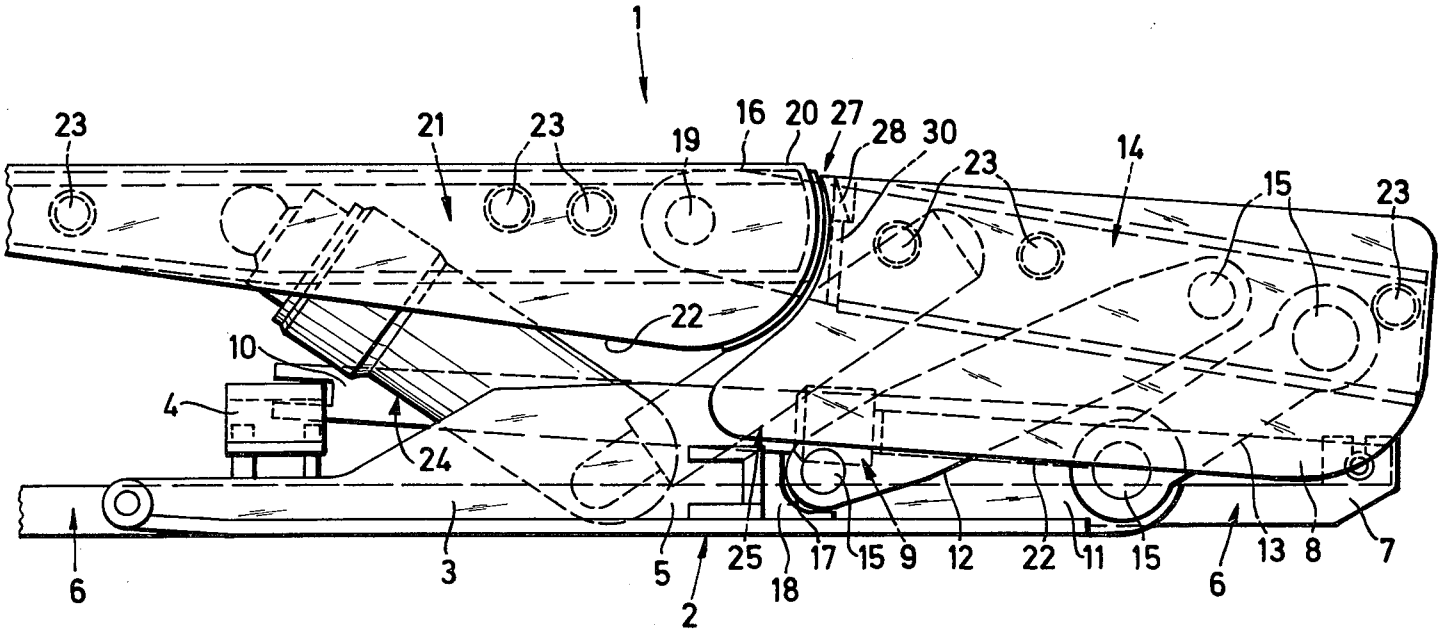
FIG. 1 is a partial side view of an arrangement for supporting roofs of underground excavations in accordance with the present invention.

FIG. 1 shows a side view of a so-called walking mine roof supporting arrangement 1 which comprises a mobile base or support 2 which is adapted to engage and move along the floor of an underground excavation in direction towards the mine face, i.e. toward the left side of FIG. 1. The support 2 have two skids or rails 5 laterally spaced from each other. Each rail 5 has a larger front section 3 which faces the mine face, and a smaller rear section 11 which faces away from the mine face. Rails 5 are connected with each other for limited pivoting movement by bridge 4 which extends intermediate the rails 5. Thus, rails 5 can move up-and-down relative to the floor and adapt to surface irregularities.

The support 2 is stepwise advanced towards the left side of FIG. 1 by a hydraulic piston-cylinder unit 9. Cylinder 10 is pivotally connected to bridge 4; and co-acting piston 8 is pivotally connected to the rear portion 7 of advancing device 6. The other non-illustrated end of device 6 is connected to a not-illustrated, conventional scraper conveyor which engages the mine face and which moves transversely of the advancement path of the mine roof supporting arrangement 1 for removing material from the mine face, thereby providing room for the arrangement 1 to stepwise advance in direction towards the mine face.

Link pair 12 and link pair 13 both have respective ends which are pivotally connected at axles 15 to the outer side of a respective section 11 of rails 5, and also to a rear shield 14. The two link pairs 12, 13 constitute a lemniscate-type linkage for the rear shield 14. Each rounded end 17 of link pair 12 engages a curved surface of support bearings 18 which are mounted on each rail 5.

Rear shield 14 is of one-piece construction and extends upwardly in direction from the floor-engaging support 2 towards the roof, and forwardly in direction from the rear of the arrangement toward the bridge 4. The most forward and most elevated end (at 16) of rear shield 14 is pivotally connected at axle 19 with end 20 of roof shield or cap 21.

The movable rear shield 14 is mounted for movement towards and away from the support 2 by pit props 25. Each pit prop 25 has a lower tube connected to one of the rails 5, and an upper tube connected to the rear shield 14 and telescopingly receiving the lower tube so that the prop 25 can be extended and/or retracted. The rear shield 14 is independently controllable and movable by prop 25 and serves not only to aid in supporting the roof of the excavation, but also to prevent any matter—if ore falls from the roof—from thrusting underneath the arrangement 1 and interfering with the stepwise advancement thereof.

Cap 21 is also of one-piece construction, and its end 20 is formed with a plurality and preferably two slots or recesses. Each recess receives a respective link 16 which is integrally formed on rear shield 14. Links 16 are laterally spaced from each other and have a comb-like configuration.

Cap 21 is also mounted for movement towards and away from the support 2 by a pair of main pit props 24. Each main pit prop 24 comprises a lower tube connected with a respective rail 5, and an upper tube connected with cap 21 and telescopingly received in the lower tube so that the prop 24 can be extended and/or retracted. The cap 21 is independently controllable and movable, and its primary function is to supportingly engage the roof of the excavation.

Both the cap 21 and rear shield 14 have surface or sealing plates 22 mounted at their respective opposite sides. These plates 22 have resilient mountings 23 which are either springs or hydraulic units. When a plurality of mine roof supporting arrangements 1 are located side-by-side in an underground gallery, each neighboring pair of such arrangements will be resiliently mounted with each other in order to protect the respective arrangements from accidental damage.

FIG. 2 shows in enlarged view the relative positions assumed by rear shield 14 and roof shield or cap 21 in a typical operating condition wherein the arrangement 1 is situated in an underground excavation having a predetermined height. The cap 21 extends generally parallel to the floor, and the rear shield 21 has been pivoted about axis 19 to a position in which the rear shield 14 is inclined at an obtuse angle of inclination relative to cap 21. The exact value of the angle of inclination depends, of course, upon the particular height of the excavation.

FIG. 3 shows in enlarged view the relative positions assumed by rear shield 14 and cap 21 in another operating condition wherein the arrangement 1 is situated in an underground excavation having a height which is less than said predetermined height. In this case, the relative angle of inclination becomes greater and approaches 180°. If the rear shield 14 were permitted to go beyond 180°, then the rear end of rear shield 14 would be elevated relative to the front end 16 of rear shield 14. The rear end of rear shield 14 would then engage the roof and prevent further stepwise advancement of the arrangement. Moreover, the shield 14 would not effectively reinforce the roof shield 21 in supporting the roof. The danger of tipping over of the entire arrangement, as well as a possible cave-in are greatly increased.

In order to prevent such evidently adverse circumstances from occurring, the present invention proposes to limit the relative movement of the shields beyond a predetermined position. More particularly, further pivoting of shield 14 relative to cap 21 is prevented when the shield 14 is inclined at a predetermined angle of inclination relative to cap 21. The exact value of this predetermined angle of inclination varies in dependence upon the particular application. Typically, however, this angle lies between 90° and 180°. As shown in FIG. 1 and FIG. 3, in an extreme case, this angle is obtuse and is slightly less than 180°.

In a preferred embodiment, the limiting means comprises first abutting means or at least one nose-shaped projection 28 which extends outwardly from curved rear surface 26 of end 20 of cap 21 across gap 27 towards rear shield 14. Projection 28 has a first abutting surface 33 and a first outer tapered surface. Each projection 28 is a thin-walled plate which is located laterally adjacent a respective slot which receives a respective link 16 of the shield 14.

The limiting means further comprises second abutting means or at least one bracket 30 having wall portions bounding a recess for receiving projection 28. Each bracket 30 is L-shaped and has a first longer wall portion 31 and a second shorter wall portion 32. Each bracket has a second abutting surface 34 which faces and contacts the first abutting surface 33 when the shield 14 is inclined at a predetermined angle of inclination relative to the cap 21. Each bracket 30 is located laterally adjacent a respective link 16 of shield 14 and is welded to the latter along welding seam 29.

The tapered outer surface of projection 28 and of bracket 30 generally extend parallel to each other when the shield 14 is inclined at said predetermined angle of inclination relative to the cap 21. It is noted that the projection 28 and bracket 30 do not restrict any relative movement of the shields 14, 21 in any other inclined position, and that any loose rock or ore falling from the roof of the excavation will not collect and jam the pivotable shields during their relative movement.

It will be understood that each of the elements described above, or two or more together, may also find a useful application in other types of constructions differing from the types described above.

While the invention has been illustrated and described as embodied in an arrangement for supporting roofs of underground excavations, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an arrangement for supporting roofs of underground excavations, a combination comprising a support adapted to engage the floor of an underground excavation; a movable roof shield for engaging the roof of the underground excavation; a movable rear shield mounted on said support and pivotally connected with said roof shield for relative movement thereto about a pivot axis; means arranged between said support and each of said shields for moving said shields independently from and relative to each other between a plurality of inclined positions in which said shields are inclined at different angles of inclination relative to each other; and cooperating means respectively fixed to said roof shield and said rear shield for limiting movement of said shields beyond a predetermined one of said inclined positions in which said shields are inclined with a predetermined angle of inclination relative to each other.

2. The arrangement as defined in claim 1, wherein said shields are elongated and have respective end regions which are pivotally connected to each other, and wherein said cooperating means comprise first abutment means fixed to one of said end regions and second abutment means fixed to the other end region and engaging said first abutment means when said shields are inclined at said predetermined angle of inclination with respect to each other.

3. The arrangement as defined in claim 2, wherein said first abutting means comprises a nose-shaped projection on said end region of said roof shield, and wherein said second abutting means constitutes a bracket on said end region of said rear shield, said bracket having wall portions bounding a recess for receiving said projection.

4. The arrangement as defined in claim 3, wherein said projection has a first abutment surface, and wherein said bracket has a longer wall portion and a shorter wall portion of one-piece with said longer wall portion, said shorter wall portion having a second abutment surface which faces said first abutment surface and contacts the latter when said shields are inclined at said predetermined angle of inclination relative to each other.

5. The arrangement as defined in claim 4, wherein said projection has a first tapered outer surface, and wherein said bracket has a second tapered outer surface which extends substantially parallel to said first tapered outer surface when said shields are inclined at said predetermined angle of inclination relative to each other.

6. The arrangement as defined in claim 1, wherein said predetermined angle of inclination is less than 180°.

7. The arrangement as defined in claim 1, wherein said predetermined angle of inclination lies in a range between 90° and 180°.

* * * * *